US009510644B2

(12) United States Patent
Bramani

(10) Patent No.: US 9,510,644 B2
(45) Date of Patent: Dec. 6, 2016

(54) HIGH FOOT MOBILITY SHOE

(75) Inventor: Marco Bramani, Milan (IT)

(73) Assignee: VIBRAM S.P.A., Albizzate (VA) (IT)

( * ) Notice: Subject to any disclaimer, the term of this patent is extended or adjusted under 35 U.S.C. 154(b) by 0 days.

(21) Appl. No.: 13/148,688

(22) PCT Filed: May 4, 2010

(86) PCT No.: PCT/IB2010/051954

§ 371 (c)(1),
(2), (4) Date: Aug. 8, 2012

(87) PCT Pub. No.: WO2011/138639

PCT Pub. Date: Nov. 10, 2011

(65) Prior Publication Data

US 2013/0036629 A1 Feb. 14, 2013

(51) Int. Cl.
*A43B 7/26* (2006.01)
*A43B 13/22* (2006.01)

(52) U.S. Cl.
CPC ..... *A43B 7/26* (2013.01); *A43B 13/223* (2013.01)

(58) Field of Classification Search
CPC ..... A43B 3/0036; A43B 5/00; A43B 5/06; A43B 13/14; A43B 13/22; A43B 1/04; A43B 3/14; A43B 7/26; A43B 9/16; A43B 9/18; A43B 9/20
USPC ..... 36/9 R, 59 C, 8.1, 102, 94; 2/239, 409; D2/902, 951
See application file for complete search history.

(56) References Cited

U.S. PATENT DOCUMENTS 3,128,763 A * 4/1964 Langenfeld et al. ..... 128/894
3,258,860 A * 7/1966 Winson ..... A43B 1/10 36/10
3,967,390 A * 7/1976 Anfruns ..... 36/94
4,494,266 A * 1/1985 Bartneck ..... A43B 9/02 12/142 RS
4,651,354 A * 3/1987 Petrey ..... 2/239
5,465,507 A * 11/1995 Schumacher et al. ..... 36/30 R
5,774,898 A * 7/1998 Malpee ..... A41B 11/004 2/22
6,544,626 B1 * 4/2003 Minges ..... 428/141
(Continued)

FOREIGN PATENT DOCUMENTS

GB 2249939 5/1992
WO 9817138 A1 4/1998
(Continued)

OTHER PUBLICATIONS

International Search Report PCT/IB2010/051953; Dated Feb. 24, 2011.

(Continued)

*Primary Examiner* — Marie Bays
(74) *Attorney, Agent, or Firm* — Cantor Colburn LLP

(57) ABSTRACT

Natural mobility footwear, including a sole and an upper which together, define separate seats for toe or toe groups, the thin sole comprises at a bottom at least one distribution of ridges and valleys configured like an enhanced version of the body's own skin, the multiple parts/pieces of the sole provide a wider range of movement, much like being barefoot, the thin sole also improves the level of environmental feedback received by the foot and body, this feedback enables the body to make adjustments or corrections, which might improve balance, agility, and stability during exercise or activity.

16 Claims, 3 Drawing Sheets

(56) References Cited

U.S. PATENT DOCUMENTS

| | | | | |
|---|---|---|---|---|
| 7,082,703 | B2 * | 8/2006 | Greene | A43B 3/0026 36/128 |
| 7,101,604 | B1 * | 9/2006 | Minges | 428/141 |
| D569,082 | S * | 5/2008 | Hatfield et al. | D2/952 |
| D569,590 | S * | 5/2008 | Hatfield et al. | D2/952 |
| D575,040 | S | 8/2008 | Bramani | |
| D625,906 | S * | 10/2010 | Zhang | D2/898 |
| 7,805,860 | B2 * | 10/2010 | Fliri | 36/94 |
| D626,311 | S * | 11/2010 | Zhang | D2/898 |
| D647,290 | S * | 10/2011 | Bramani | D2/952 |
| D674,170 | S * | 1/2013 | Bramani et al. | D2/902 |
| 8,572,868 | B2 * | 11/2013 | Fliri | 36/94 |
| D697,704 | S * | 1/2014 | Vestuti et al. | D2/955 |
| 8,683,718 | B2 * | 4/2014 | Fliri | 36/94 |
| 2003/0089000 | A1 * | 5/2003 | Tseng | A43B 1/00 36/45 |
| 2005/0091725 | A1 * | 5/2005 | Alley | 2/139 |
| 2005/0166427 | A1 * | 8/2005 | Greene et al. | 36/128 |
| 2006/0165269 | A1 | 7/2006 | Lin | |
| 2007/0120293 | A1 * | 5/2007 | Herber | A43B 3/10 264/299 |

FOREIGN PATENT DOCUMENTS

| | | | |
|---|---|---|---|
| WO | 2005037004 | A1 | 4/2005 |
| WO | 2007038487 | A2 | 4/2007 |

OTHER PUBLICATIONS

International Search Report PCT/IB2010/051954; Dated Feb. 28, 2011.

* cited by examiner

HIGH FOOT MOBILITY SHOE

TECHNICAL FIELD

This invention refers to a shoe with high mobility for the foot.

BACKGROUND

Certain types of footwear are known and commercially available that reproduce the natural shape of the foot, in order to ensure better articular mobility especially of the toes and to give more comfort during the action of walking, giving the user the sensation of walking on bare feet while ensuring the necessary protection.

Such a type of footwear is described in the international patent application WO2007/038487 of the same applicant. This patent application describes a shoe in which the front part defines multiple portions independent of each other and made of flexible material to accommodate corresponding toes; such portions involve both the upper and the sole of the shoe.

In such shoe the sole is provided with some substantially transverse notches of different dimensions, which are aimed at increasing the flexibility thereof and thus the feeling of comfort when walking.

However, it has been noted, in the practical use of the shoe, that these notches are sometimes less than sufficiently effective with regard to grip on ground in various conditions of use. Indeed, it has been observed that in some specific adverse conditions, such as wet or slippery ground, the friction and grip on the ground generated by the shoe are less likely to provide the user with a desired stability, balance and traction while walking. This can be disadvantageous, especially where the shoe is used in specific sports or recreational activities that require the support of the foot on slippery and/or tilted surfaces.

BRIEF SUMMARY OF THE INVENTION

The invention develops a shoe providing high mobility to the foot and achieving optimal adhesion and friction on the ground, even under very unfavorable conditions, such as slippery and/or inclined surfaces.

The invention further provides a high foot mobility shoe that boosts the user comfort in the walk, in the race, or while performing other movements being supported by the foot.

An important advantage achieved by the shoe according to the present invention is that it allows to obtain, as to the support of the foot on the ground, the best adhesion and friction conditions, with no danger of sudden slipping or loss of contact, along with a high mobility of the foot and of the toes thereof. These conditions are provided even in unfavorable situations such as those wherein the support of the foot occurs on wet and/or slippery and/or tilted surfaces.

Another advantage of the present invention is that the shoe according the present invention provides increased comfort conditions for the support of the foot on the ground, especially with respect to damping the impact.

BRIEF DESCRIPTION OF THE DRAWINGS

These and further advantages will be better understood by every skilled person from the following technical description and the attached drawings, given as a non-limitative example, in which.

EMBODIMENTS OF THE INVENTION

Figure 1:
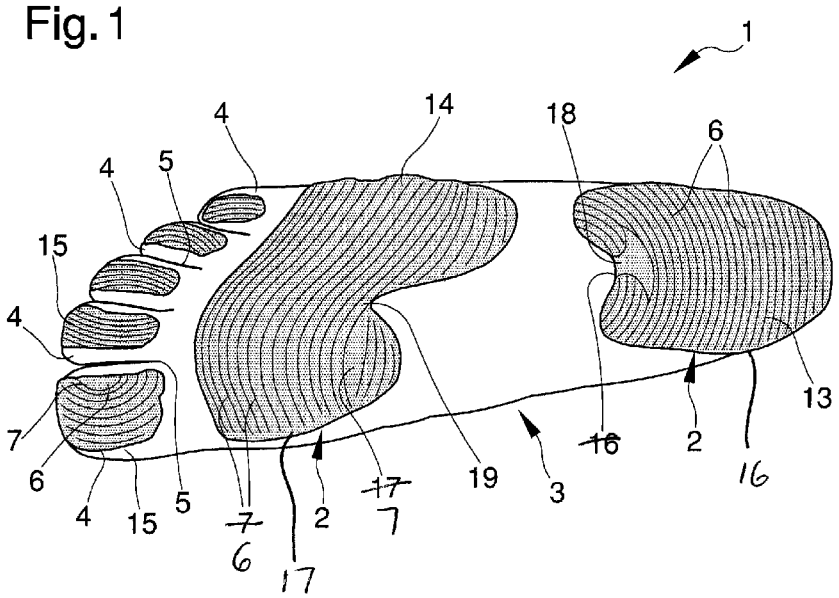
FIG. 1 is a bottom view of the shoe according to the present invention.

With reference to FIG. 1, there is indicated as a whole with 1 a high foot mobility shoe according to the invention.

The shoe according to the invention is of general use, particularly but not exclusively indicated, thanks to its characteristics, for sports, recreation activities and the like.

Figure 2:
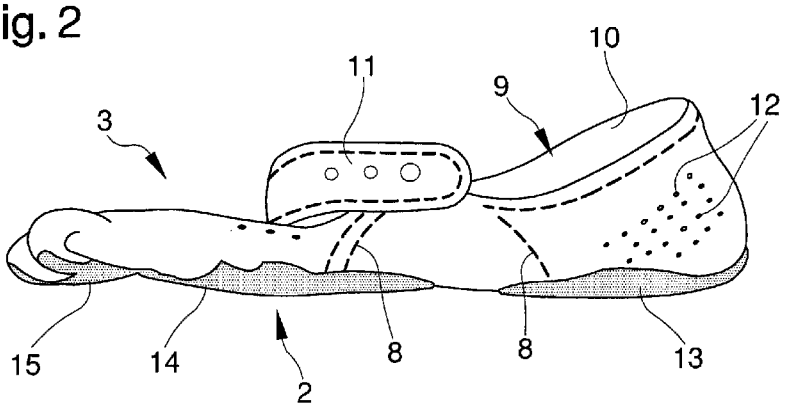
FIG. 2 is a side view of the shoe.

Referring now to FIG. 2, the shoe 1 comprises a sole, indicated as a whole by 2, and an upper generally indicated with 3, mutually attached together so as to cover completely or almost completely the surface of the foot.

Figure 3:
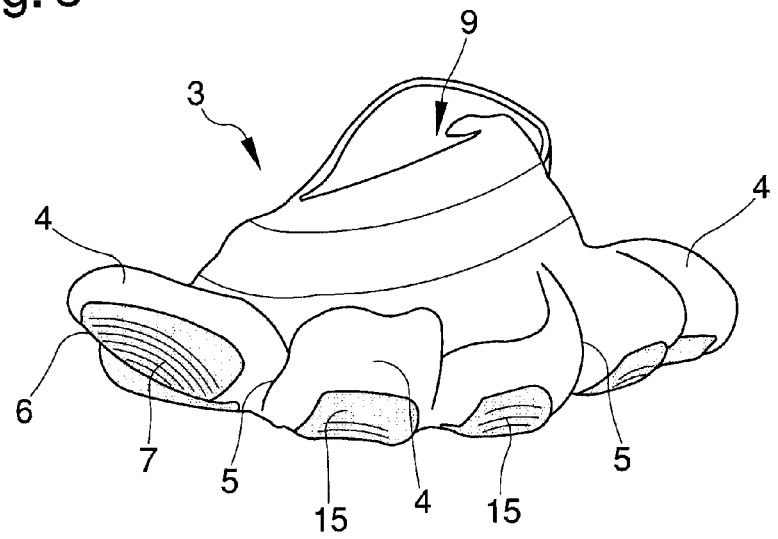
FIG. 3 is a front view of the shoe.

The sole 2 and the upper 3, as shown in FIG. 3, define front seats 4 separated each other by slots 5 for containing respective toes or group of toes of the foot.

More specifically, there are provided five front seats 4 separated each other by slots 5 for containing the five respective toes of the foot.

Advantageously, the sole 2 of the shoe 1 comprises at the bottom at least one distribution of ridges 6 and valleys 7 conformed like dermatoglyphics, in order to achieve the important technical advantages which are discussed below.

The upper 3 of the shoe 1 is made of yielding material, such as the type of natural or synthetic leather, or even another suitable type of natural or synthetic material to be employed in the field of shoe and presenting characteristics substantially equivalent.

The upper 3 can be produced in one single part or in parts distinct from each other connected together for example by sewn edges 8, visible in FIG. 2. Furthermore, the upper 3 is provided, at the opening 9 for insertion of the foot, with an edge 10 of substantially traditional type.

As it is evident in FIG. 1, the upper 3 extends from the area of the foot dorsum to the area of the foot sole, so as to completely or almost completely embrace it.

Inside the shoe a supporting insole may be provided for supporting the sole of the foot, attached to the upper 3 and to the sole 2; said insole is not represented in the figures but is mainly well-known and traditional.

The upper 3 comprises means for fastening around the foot, indicated with the reference number 11 in FIG. 2. Such means for fastening 11 may be constituted by a buckle or other equivalent means, which however do not form the subject of this invention.

Figure 4:
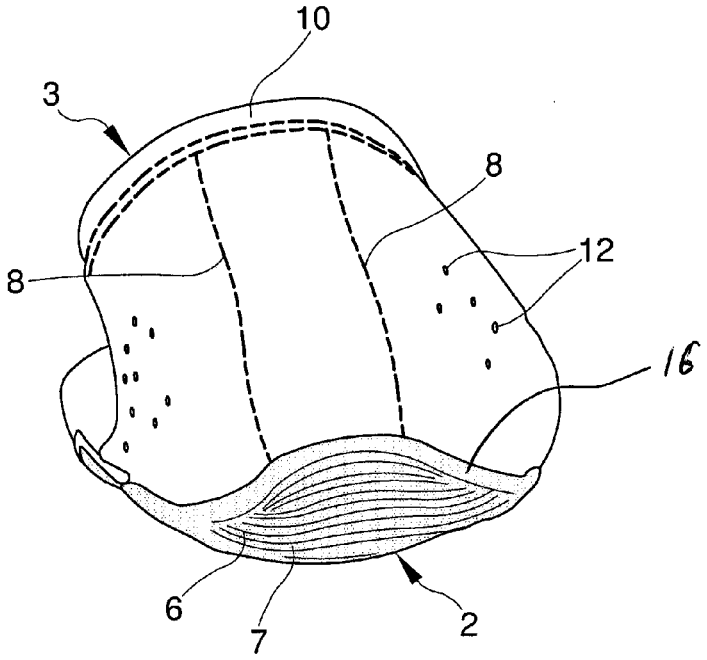
FIG. 4 is a rear view of the shoe according to the present invention.

As shown in FIGS. 2 and 4, the upper 3 is provided with ventilation holes 12, for example positioned laterally in the region of the calcaneus (heel), especially suitable for using the shoe according to the invention during the summer.

The sole 2 of the shoe is divided into separated portions positioned at different areas of the sole of the foot. More specifically, the sole 2 comprises a heel portion 13, a metatarsal portion 14, and phalangeal portions 15. This solution allows to make the sole 2 of the shoe softer and more pliable than that of known footwear, as the resistance to bending of the sole 2 is offered almost exclusively by the material that forms the upper 3, as one may appreciate by looking to FIGS. 1 and 2.

At least one of said heel portions 13, metatarsal portion 14 and phalangeal portions 15 of the sole 2 comprises a respective distribution of ridges 6 and valleys 7 conformed like dermatoglyphics. More specifically, each of said heel portions 13, metatarsal portion 14 and phalangeal portions 15 contains a respective distribution of ridges 6 and valleys 7, so as to reproduce as closely as possible the dermatoglyphics of the human foot sole, at least in the shapes: the size of the dermatoglyphics made in the sole 2 are in fact increased over the real ones, to emphasize the technical effect that will be better described below.

The metatarsal portions 13 and the heel portions 14 of the sole 2 comprise respective perimetral edges 16, 17 delimiting the respective distributions of ridges 6 and valleys 7. These edges 16, 17 save the ends of the ridges 6 from breakage, wear and tearing, thus maintaining the sole 2 intact over time. The edges 16, 17 of heel portion 13 and the metatarsal portion 14 define respective inlets 18, 19 which accomplish a thinning of the same portions 13, 14 at the tarsal area of the foot, in order to increase the softness of the sole 2 in that area.

As shown in FIGS. 1 and 3, the sole 2 comprises five phalangeal portions 15, arranged respectively at said five seats 4 separated by slots 5.

The sole 2—that is, the heel portion 13, the metatarsal portion 14 and the phalangeal portions 15 thereof—is made of elastically yielding material, such as the type of natural or synthetic rubber.

Said heel portion 13, metatarsal portion 14 and phalangeal portions 15 of the sole 2 are fixed to the upper 3 by seams; alternatively, they may be fixed to the upper 3 by gluing; still the fixing may occur by other known and equivalent connection means which are not covered by the present invention.

In practical use, the shoe according to the invention, properly worn and fastened to the foot through the fastening means 11, allows the user to walk, run and make other changes in support on the foot with maximum freedom of mobility, especially of the toes independently from each other: this allows to facilitate the tactile and prehensile activities of foot sole, giving the user the sensation of walking around on bare feet with maximum comfort and safety.

With the solution according to the invention, however, the user clearly gets other important technical advantages.

The presence of ridges and valleys 6, 7 made like dermatoglyphics in the portions 13, 14, 15 of the sole 2 of the shoe 1 ensures optimum adhesion of the sole 2 itself to all surfaces, even wet and/or slippery and/or inclined ones; indeed the valleys 7 allow the drain of possible amount of water or other fluid that may locate between the sole 2 and the ground, preventing the slipping of the user.

Furthermore, these ridges 6 and valleys 7, elastically deformable, allow to increase the friction between the sole 2 and the ground and therefore the user's ability to push in the walk and/or the run.

An additional advantage conferred by the shoe according to the present invention is that the ridges 6 deform elastically under the weight of the user, and accomplish a damping of the impact of the foot onto the ground while walking and/or running, as small cushions: in this way the user's comfort in its movements is substantially increased compared with soles essentially smooth.

Furthermore, the prehensile activity of the foot is increased, with the consequent increase of the available sprint power in running execution.

Figure 5:
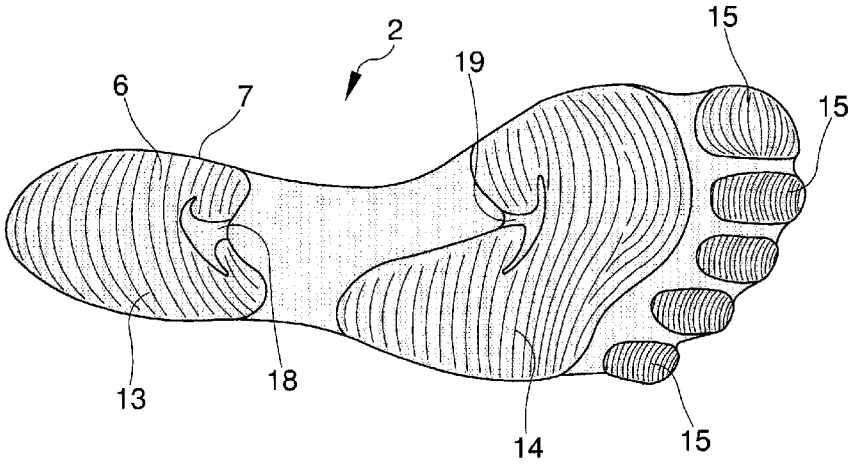
FIG. 5 is a bottom view of an alternative embodiment of the sole of the shoe according to the invention.

An alternative embodiment of the sole 2 of the shoe according to the invention is shown in FIG. 5.

In this embodiment the sole 2 is made of one single piece, e.g. of rubber or other equivalent materials, that extends substantially on the entire sole of the foot; in other words, the heel portion 13, the metatarsal portion 14 and the phalangeal portions 15, the same as the previous embodiment, are integral to each other.

This embodiment allows producing a sole 2 which is a little more elastic than the previous embodiment; also, such sole 2 ensures better protection of the foot sole in cases where, for example, the user places his foot on rough or irregular surfaces.

The present invention has been described according to preferred embodiments, but equivalent variants can be developed without going beyond the scope of protection offered by the claims that follow.

The invention claimed is:

1. High foot mobility shoe, comprising:

a sole and an upper which define separate front seats to hold respective toes or toes groups, wherein said sole is divided into separated portions positioned at different zones of the sole of the foot, wherein said separated portions of said sole comprise a heel portion and a metatarsal portion, said sole comprising at a bottom of the heel portion and the metatarsal portion a distribution of ridges and valleys configured like dermatoglyphics, in order to increase a prehensility of the foot, wherein said metatarsal portion and said heel portion of said sole comprise respective perimetral edges surrounding the respective distributions of ridges and valleys, the ridges and valleys terminating at said respective perimetral edge;

wherein the perimetral edges comprise outermost edges of the respective heel portion and the metatarsal portion;

wherein the perimetral edges have a width which extends laterally from the terminated ridges and valleys such that the perimetral edges are configured and disposed to contact the ground during walking;

wherein at least one of the heel portion and the metatarsal portion comprise a contour delimiting an inlet in the respective heel and/or metatarsal portion which accomplishes a thinning of the respective portion of said sole at the tarsal zone of the foot; and wherein the inlet comprises a substantially flat and generally smooth surface from which the ridges and valleys are absent, the inlet disposed at an interior of the respective heel and/or metatarsal portions such that the ridges and valleys extend around but do not enter the inlet.

2. Shoe according to claim 1, wherein said separated portions of said sole further comprise at least a phalangeal portion.

3. Shoe according to claim 2, wherein at least one of said separated portions of said sole comprises at least a contour which defines said distribution of ridges and valleys.

4. Shoe according to claim 1, comprising five separate seats to contain the respective five toes of the foot.

5. Shoe according to claim 4, wherein said sole comprises five phalangeal portions provided at said five separate seats.

6. Shoe according to claim 1, wherein said sole is made of an elastically yielding material.

7. Shoe according to claim 2, wherein said separated portions of said sole are fixed to said upper through seams.

8. Shoe according to claim 2, wherein said separated portions of said sole are fixed to said upper through gluing.

9. Shoe according to claim 1, wherein said upper extends to a foot dorsum and foot sole area.

10. Shoe according to claim 1, wherein said upper is made of a yielding material.

11. Shoe according to claim 1, wherein said upper comprises means for fastening around the foot.

12. Shoe according to claim 1, wherein said upper is provided with ventilation holes.

13. Shoe according to claim 1, wherein the thinning comprises an area of reduced thickness of the sole.

14. Sole for shoe, comprising:

at a bottom at least one distribution of ridges and valleys configured like dermatoglyphics; and perimetral edges surrounding the respective distributions of ridges and valleys, wherein the ridges and valleys terminate at said respective perimetral edge;

wherein the perimetral edges comprise outermost edges of the respective distributions of ridges and valleys;

wherein the perimetral edges have a width which extends laterally from the terminated ridges and valleys such that the perimetral edges are configured and disposed to contact the ground during walking; and wherein the distribution of ridges and valleys comprise a contour delimiting an inlet in the distribution of ridges and valleys which accomplishes a thinning of the distribution of ridges and valleys; and wherein the inlet comprises a substantially flat and generally smooth surface from which the ridges and valleys are absent, the inlet disposed at an interior of the distribution of ridges and valleys such that the ridges and valleys extend around but do not enter the inlet.

15. Sole according to claim 14, comprising a heel portion, a metatarsal portion and phalangeal portion provided with a respective distribution of said ridges and valleys configured like dermatoglyphics.

16. High foot mobility shoe, comprising:

a sole and an upper which define separate front seats to hold respective toes or toes groups, wherein said sole is divided into separated portions positioned at different zones of the sole of the foot, wherein said separated portions of said sole comprise a heel portion and a metatarsal portion, said sole comprising at a bottom of the heel portion and the metatarsal portion a distribution of ridges and valleys configured like dermatoglyphics, in order to increase a prehensility of the foot, wherein said metatarsal portion and said heel portion of said sole comprise respective perimetral edges surrounding the respective distributions of ridges and valleys, the ridges and valleys terminating at said respective perimetral edge;

wherein the perimetral edges comprise outermost edges of the respective heel portion and the metatarsal portion;

wherein the perimetral edges have a width which extends laterally from the terminated ridges and valleys such that the perimetral edges are configured and disposed to contact the ground during walking;

wherein said upper extends to a foot dorsum and a foot sole area and is configured to surround a foot of wearer, the foot sole area being disposed to align with a bottom of the foot of the wearer, and sole of the shoe being affixed to an outside of the upper at the foot sole area;

wherein at least one of the heel portion and the metatarsal portion comprise a contour delimiting an inlet in the respective heel and/or metatarsal portion which accomplishes a thinning of the respective portion of said sole at the tarsal zone of the foot; and wherein the inlet comprises a substantially flat and generally smooth surface from which the ridges and valleys are absent, the inlet disposed at an interior of the respective heel and/or metatarsal portions such that the ridges and valleys extend around but do not enter the inlet.

* * * * *